US007431439B2

(12) United States Patent
Fujioka

(10) Patent No.: US 7,431,439 B2
(45) Date of Patent: Oct. 7, 2008

(54) LIQUID SUPPLY DEVICE AND RECORDING APPARATUS INCORPORATING THE SAME

(75) Inventor: Satoshi Fujioka, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 232 days.

(21) Appl. No.: 10/835,278

(22) Filed: Apr. 30, 2004

(65) Prior Publication Data

US 2005/0041075 A1 Feb. 24, 2005

(30) Foreign Application Priority Data

May 1, 2003 (JP) ..... P2003-126179

(51) Int. Cl.
*B41J 2/175* (2006.01)
*B41J 29/38* (2006.01)

(52) U.S. Cl. ..... 347/86; 347/85; 347/6

(58) Field of Classification Search ..... 347/84–87, 347/6–7

See application file for complete search history.

(56) References Cited

U.S. PATENT DOCUMENTS 5,771,053 A * 6/1998 Merrill ..... 347/86
6,276,788 B1 * 8/2001 Hilton ..... 347/86
7,011,400 B2 * 3/2006 Nakano ..... 347/101
2002/0145650 A1 * 10/2002 Pan et al. ..... 347/85
2002/0171723 A1 * 11/2002 Ota et al. ..... 347/86
2003/0128261 A1 * 7/2003 Usui et al. ..... 347/86
2004/0012655 A1 * 1/2004 Thielman et al. ..... 347/85
2004/0119799 A1 * 6/2004 Kulpa et al. ..... 347/86

FOREIGN PATENT DOCUMENTS

JP 11-78049 3/1999
JP 2001-353881 A 12/2001

* cited by examiner

*Primary Examiner*—Julian D. Huffman
*Assistant Examiner*—Jason S Uhlenhake
(74) *Attorney, Agent, or Firm*—Sughrue Mion, PLLC

(57) ABSTRACT

In a device for supplying liquid from a liquid cartridge to a liquid ejection head via a liquid supply channel, a cartridge chamber accommodates the liquid cartridge. A valve is disposed between the liquid cartridge and the liquid supply channel. A control lever is adapted to be manually operated by a user to control the valve so as to connect or disconnect the liquid cartridge and the liquid supply channel.

14 Claims, 12 Drawing Sheets

LIQUID SUPPLY DEVICE AND RECORDING APPARATUS INCORPORATING THE SAME

BACKGROUND OF THE INVENTION

The present invention relates to a liquid supply device for supplying liquid contained within a cartridge to a recording head via a liquid supply channel. The invention also relates to a recording apparatus incorporating such a liquid supply device.

Ink jet printers are available that are one kind of large-sized recording apparatus capable of printing on from sheets of paper of Japanese JIS (Japanese Industrial Standard) A4 size up to relatively large sized sheets, for example of JIS A2 size, the sheets being recording media. Since the ink jet printer uses a large amount of ink, an ink cartridge holder for detachably holding ink cartridges storing large amounts of ink to be supplied to the recording head are disposed on the front side of the printer body.

When such an ink cartridge is attached or detached, it is necessary to prevent air from entering an ink tube that connects the ink cartridge holder and the recording head. Japanese Patent Publication No. 11-78049A teaches that the ink tube is closed by activating a valve disposed on the ink tube by utilizing the force for driving the paper feeding roller.

Since the valve is opened and closed by making use of the force for driving the paper feeding rollers, if the rollers are driven incorrectly, there is an anxiety that the state of the valve (i.e., whether it is open or closed) is recognized inversely.

SUMMARY OF THE INVENTION

It is therefore an object of the invention to provide a liquid supply device capable of certainly recognizing the state of a valve (i.e., whether it is open or closed) provided with a liquid supply channel.

It is also an object of the invention to provide a recording apparatus incorporating such a liquid supply device.

In order to achieve the above objects, according to the invention, there is provided a device for supplying liquid from a liquid cartridge to a liquid ejection head via a liquid supply channel, the device comprising:

a cartridge chamber, which accommodates the liquid cartridge;

a valve, disposed between the liquid cartridge and the liquid supply channel; and a control lever, adapted to be manually operated by a user to control the valve so as to connect or disconnect the liquid cartridge and the liquid supply channel.

In such a configuration, it is prevented the state of the valve (i.e., whether it is open or closed) from being recognized incorrectly. Hence, inflow of air into the liquid supply channel can be prevented with certainty when the cartridge is loaded or unloaded.

Preferably, information writing with respect to a storage disposed on the liquid cartridge is enabled or inhibited in accordance with the operation of the control lever.

Here, it is preferable that the information writing is enabled when the valve connects the liquid cartridge and the liquid supply channel.

In such configurations, malfunction of the liquid supply device due to failure of writing of the information about the liquid or the like can be prevented.

Preferably, the device further comprises a retainer which retains the liquid cartridge in the cartridge chamber, the retainer being operated interlockingly with the operation of the control lever.

Here, it is preferable that the retainer releases the retention of the retainer only when the valve disconnect the liquid cartridge from the liquid supply channel.

In such configurations, inflow of air into the liquid supply channel can be prevented with further certainty when the cartridge is loaded or unloaded.

Preferably, the device further comprises a transmitter which coverts the operation of the control lever into the connecting or disconnecting operation of the valve in a leverage manner.

In such a configuration, the valve can be actuated by a small force with a simple structure.

According to the invention, there is also provided a liquid ejection apparatus, comprising:

a liquid ejection head, from which a liquid droplet is ejected;

a liquid supply path, communicated with the liquid ejection head to supply liquid thereto from a liquid cartridge;

a cartridge chamber, which accommodates the liquid cartridge;

a valve, disposed between the liquid cartridge and the liquid supply channel; and a control lever, adapted to be manually operated by a user to control the valve so as to connect or disconnect the liquid cartridge and the liquid supply channel.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE INVENTION

Figure 1:
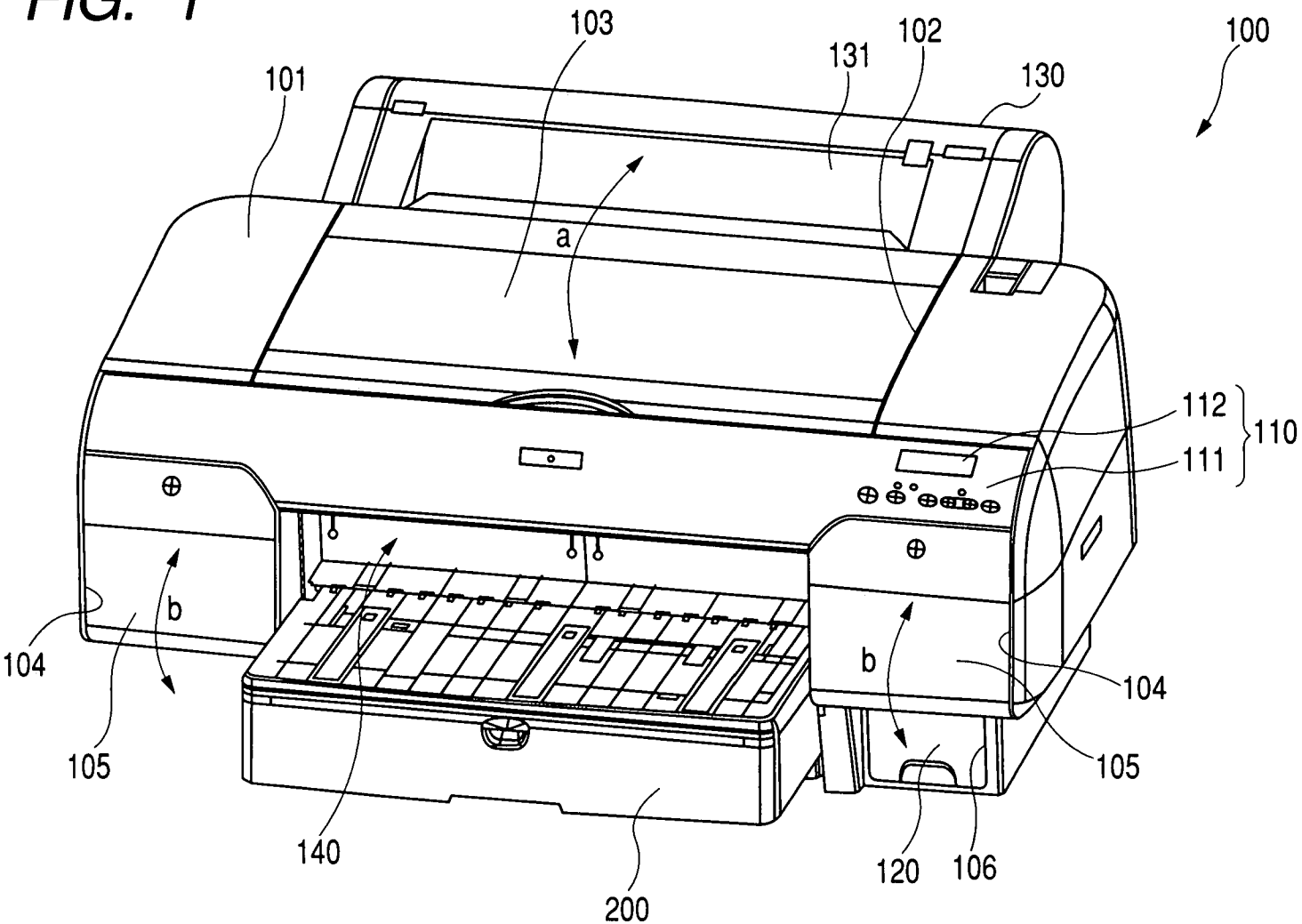
FIG. 1 is a perspective view of a recording apparatus according to one embodiment of the invention.

One embodiment of the invention will be described below in detail with reference to the accompanying drawings.

An ink jet printer 100 is a large-sized desktop printer capable of printing on so-called cut sheets of paper from JIS A4 size to a relatively large size, for example JIS A2 size, and on rolled paper.

A rectangular window 102 is formed on the top face of a housing 101. This window 102 is covered with a transparent or translucent cover 103. The cover 103 is mounted to be rotatable in the directions indicated by the arrows "a". The user can perform the maintenance operation with respect to the internal structure through the window 102 by opening the cover 103.

Cartridge chambers 104 are formed on both sides of the front face of the housing 101. Plural ink cartridges are detachably accommodated in the cartridge chambers 104. Ink of each color for printing is stored in each ink cartridge. Each cartridge chamber 104 is covered with a transparent or translucent cartridge cover 105. This cartridge cover 105 is mounted to be rotatable in the directions indicated by the arrows "b". The user can exchange the ink cartridge or perform other operation by opening the cartridge cover 105.

A control panel 110 for giving an instruction to operate the printer is disposed above the cartridge chamber 104 on the front right side of the housing 101. The control panel 110 has buttons 111 including one for activating or deactivating the printer, one for performing a position adjustment of paper, one for performing a flushing operation of the recording head, and one for performing image processing, for example. The control panel 110 is also provided with a liquid crystal panel 112 for displaying the status of the printer. The user may operate the buttons 111 while watching and checking the liquid crystal panel 112.

A tank chamber 106 in which a waste liquid tank 120 is detachably accommodated is formed under the cartridge chamber 104 on the front right side of the housing 101. Waste ink that is discarded during cleaning of a recording head 162 (see FIG. 5) or when any ink cartridge is exchanged is stored in the waste liquid tank 120. The user pulls out the waste liquid tank 120 to discard the waste ink stored therein.

A paper feeder 130 for feeding rolled paper is disposed on the back face of the housing 101. Rolled paper holder (not shown) on which one rolled paper can be set is disposed inside the paper feeder 130. Rolled paper cover 131 is mounted on the front side of the paper feeder 130 so as to cover the rolled paper holder (not shown). The user may load and unload rolled paper by opening the rolled paper cover 131. The top face of the rolled paper cover 131 serves as a paper feeding guide that permits a cut sheet of paper to be manually fed.

A paper feeder/ejector 140 to which a cassette tray 200 is detachably mounted is formed in the center of the front face of the housing 101, i.e., between the pair of cartridge chambers 104. Unprinted cut sheet, printed cut sheet, or rolled paper is loaded on the tray 200. The paper feeder/ejector 140 is so configured that paper having a thickness incapable of bending during transportation can be fed manually.

Figure 2:
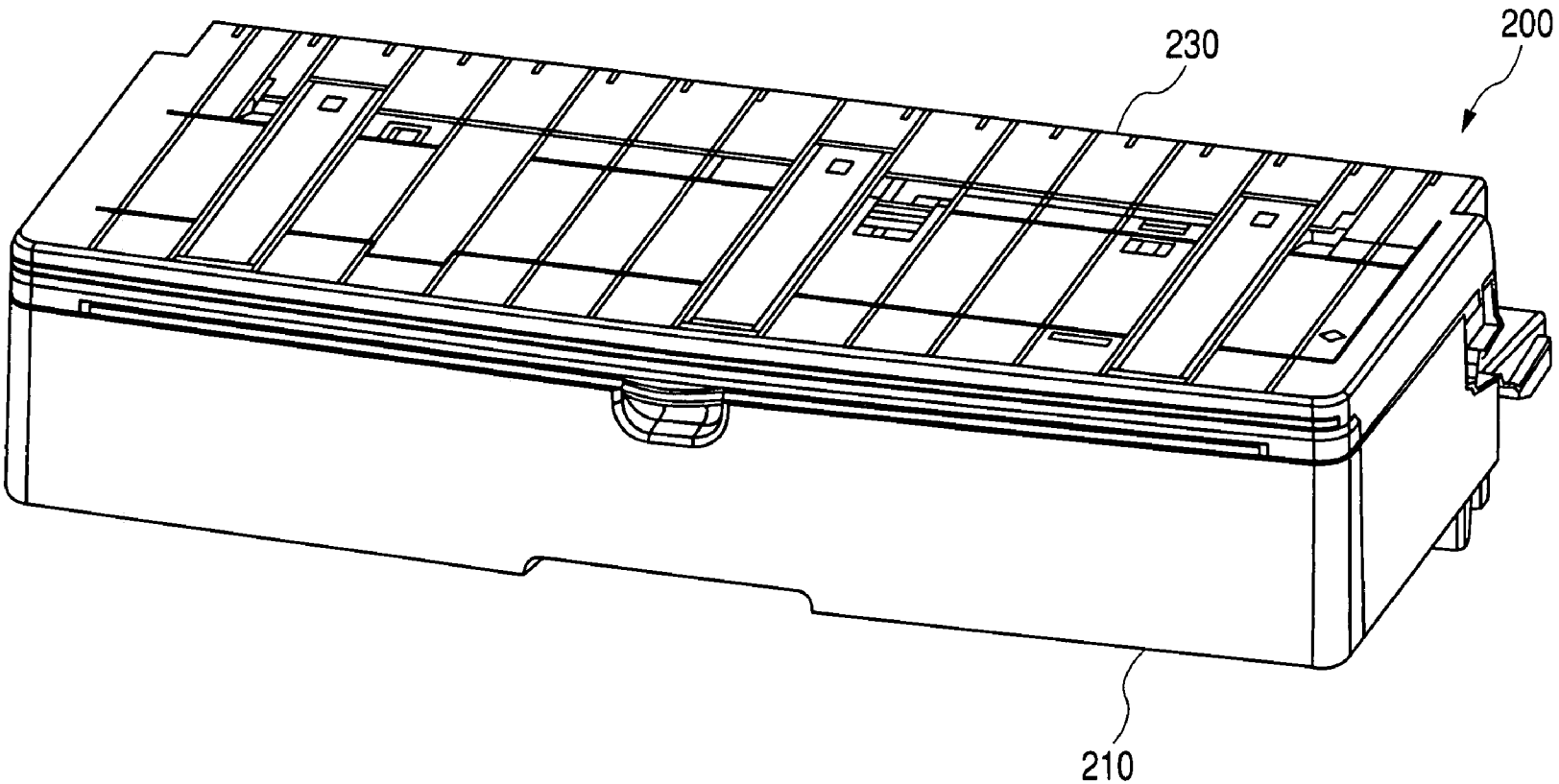
FIG. 2 is a perspective view of a tray cassette incorporated in the recording apparatus of FIG. 1.

The front portion of the cassette tray 200 is inserted into the paper feeder/ejector 140, so that the rear portion of the cassette tray 200 is projected from the front face of the housing 101. Unprinted cut sheets are stacked within the cassette tray 200. Printed cut sheets or rolled paper that are ejected are stacked on the top face of the cassette tray 200. The details of the cassette tray will be described with reference to FIG. 2.

Figure 3:
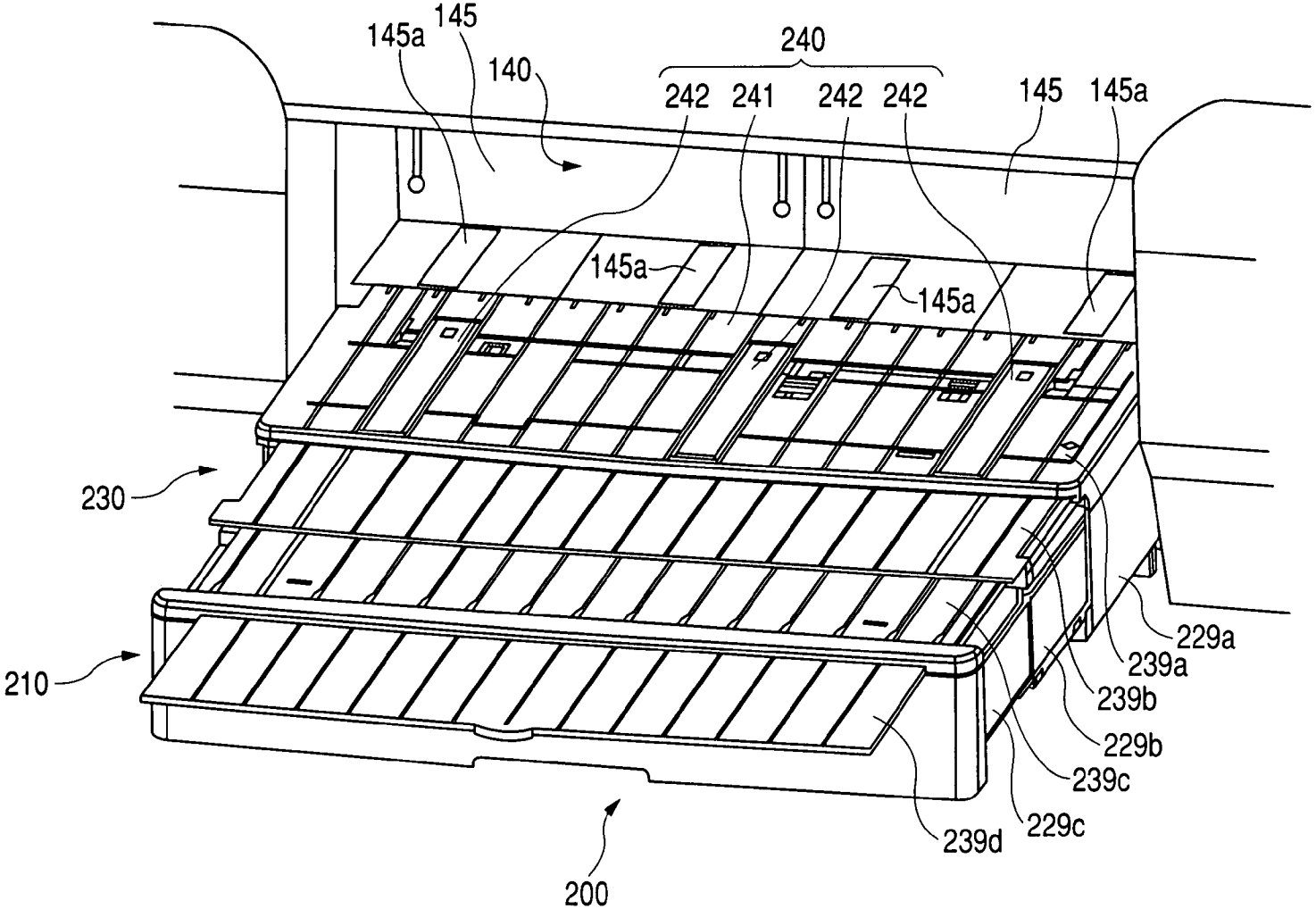
FIGS. 3 and 4 are perspective views showing states that the cassette tray of FIG. 2 is used.

The cassette tray 200 has a box-shaped paper feeding tray 210 and a paper ejection tray 230 for covering the top face of the paper feeding tray 210. As shown in FIG. 3, the paper ejection tray 230 may be stretched in the paper ejecting direction when it is in use so as to adapt to various sized of ejected paper, whereas may be contracted so as to be made compact when it is not in use.

Where cut sheets of paper are ejected and stacked, a rolled paper guide 240 is housed under the top face of a tray member 239*a* as shown in FIG. 3. That is, the top face of the tray member 239*a* is made flat. Thus, cut sheets of paper that are ejected through a paper ejection roller 155 (see FIG. 5) are smoothly stacked and placed on an ejection tray face that is formed by a guide 145 and tray members 239*a*-239*d*.

A sponge mat 145*a* is bonded on the guide 145. When the second cut sheet of paper is ejected after the first cut sheet is placed, the sponge mat 145*a* prevents the leading edge of the second cut sheet of paper from striking the first cut sheet; otherwise the first sheet would be dropped off from the ejection tray face.

Figure 4:
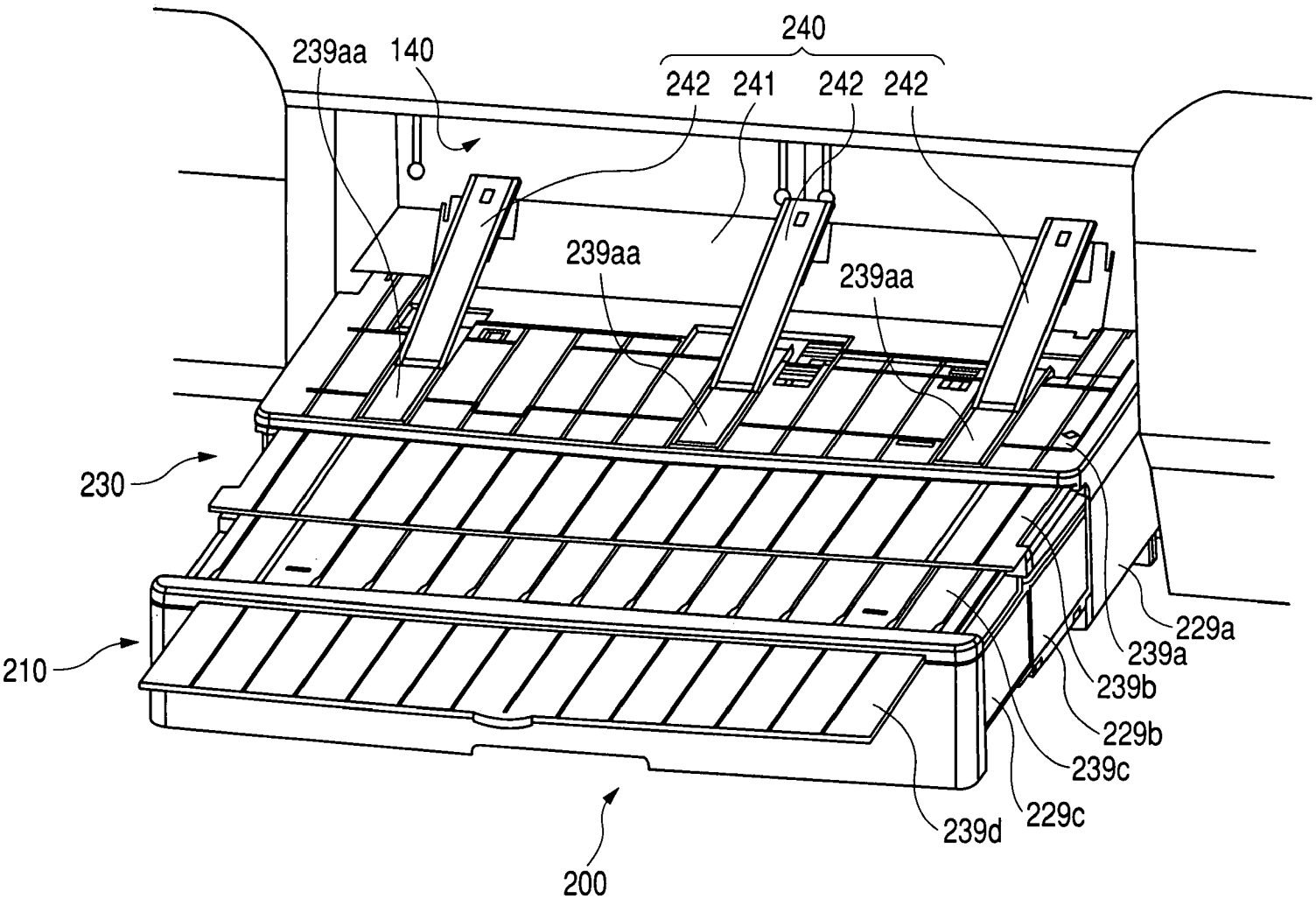

As shown in FIG. 4, in a case where rolled paper is ejected and stacked, the user pivots a first guide plate 241 rearward. Incidentally, second guide plates 242 are accordingly pulled rearward along grooves 239*aa* formed on the top face of the tray member 239*a*. The first guide plate 241 is pivoted until an angle formed by the first guide plate 241 and the second guide plates 242 are made acute.

The ejected rolled paper is fed along the slide-shaped second guide plates 242 and guided to the ejection tray face without proceeding to the side of the guide 145 even if a leading end of the ejected rolled paper is curled. Accordingly, the rolled paper is smoothly stacked and placed on the ejection tray face.

Figure 5:
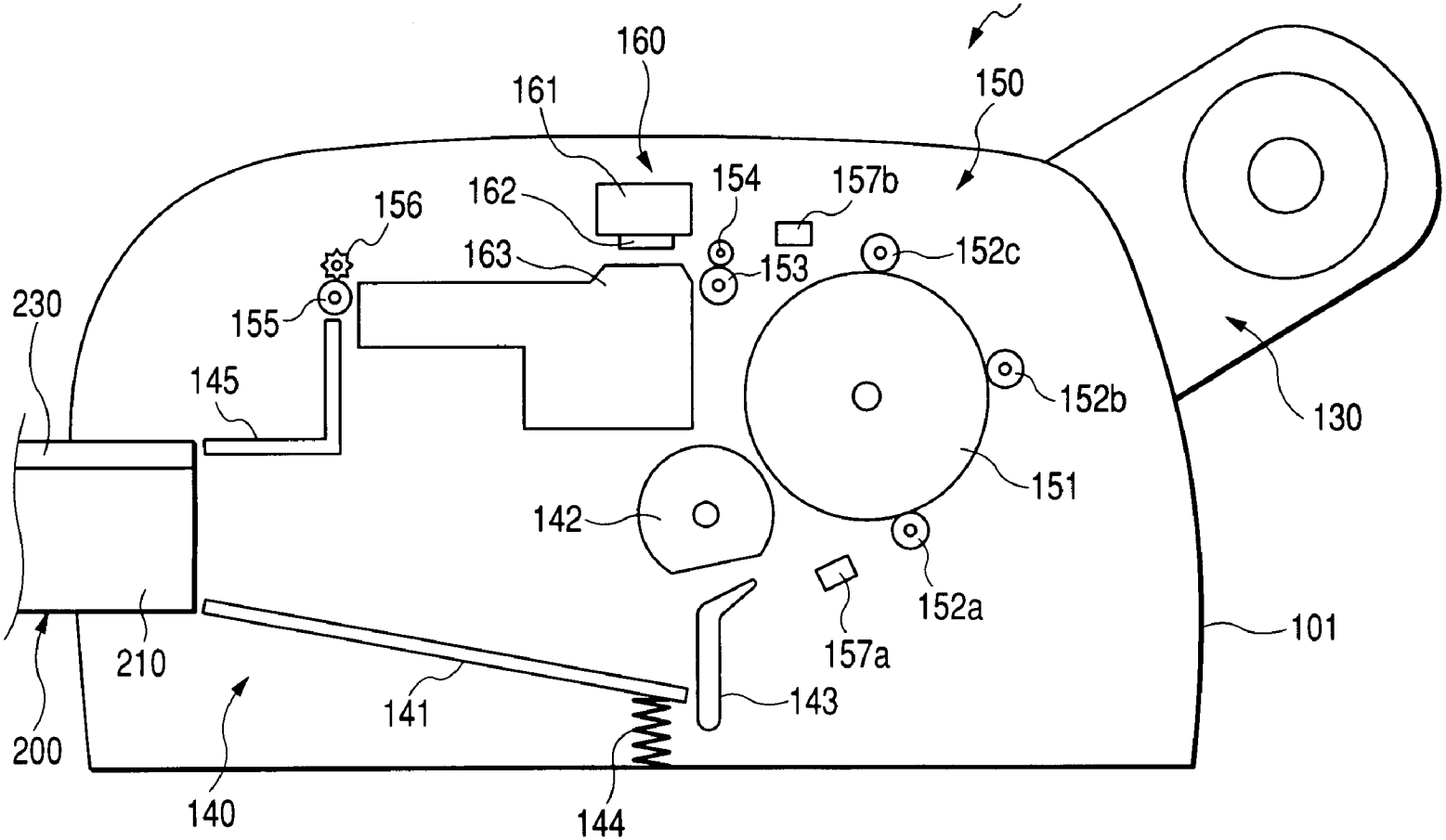
FIG. 5 is a schematic side view of an internal configuration of the recording apparatus of FIG. 1.

As shown in FIG. 5, the paper feeder/ejector 140, a transporting section 150, a recording section 160 are disposed inside the housing 101. A hopper 141 for feeding cut sheets of paper, a paper feeding roller 142, a separator 143 are disposed in the paper feeder/ejector 140. The plate-shaped hopper 141 is formed such that cut sheets of paper can be stacked thereon. The hopper 141 is so located that its one end is close to the paper feeding roller 142 and to the separator 143 and that the other end is close to the bottom face of the paper feeding tray 210 of the mounted cassette tray 200. One end of a compression spring 144 is mounted on the bottom face of the housing 101, while the other end is mounted on the back face of the hopper 141. Expansion and contraction of the compression spring 144 pivots one end side of the hopper about the other end side.

The paper feeding roller 142 is provided with a flat part so as to have a D-shaped cross section, and rotates in steps to frictionally convey the cut sheets of paper on the hopper 141. The top face of the separator 143 is formed roughly. When overlapped cut sheets of paper are collectively sent by the paper feeding roller 142, the cut sheet in the lower layer is frictionally separated from the cut sheet in the top layer. The relation between the cut sheets of paper placed on the hopper 141 and the paper feeding roller 142 is described with reference to FIGS. 6A and 6B.

Figure 6A:
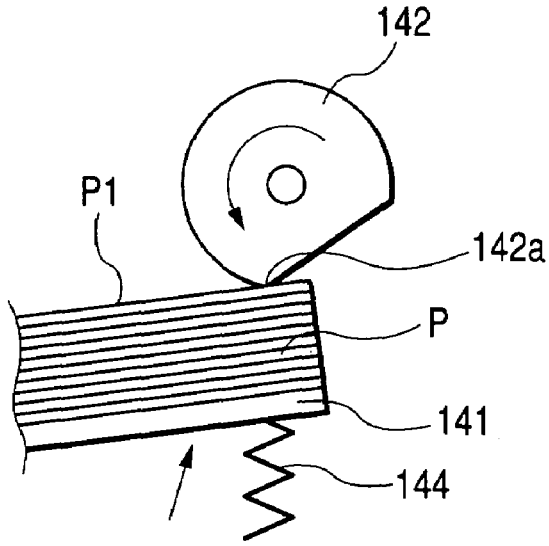
FIGS. 6A and 6B are schematic side views showing an operation of a hopper and a paper feeding roller incorporated in the recording apparatus of FIG. 1.

FIG. 6A shows a case where the maximum number of cut sheets P are stacked on the hopper 141. In this case, when the hopper 141 is moved upward, it is so configured that the top cut sheet P1 is not brought into contact with the flat part of the paper feeding roller 142, but is brought into contact with the arcuate part of the paper feeding roller 142 which follows a point 142*a* according to the rotation of the paper feeding roller 142.

Figure 6B:
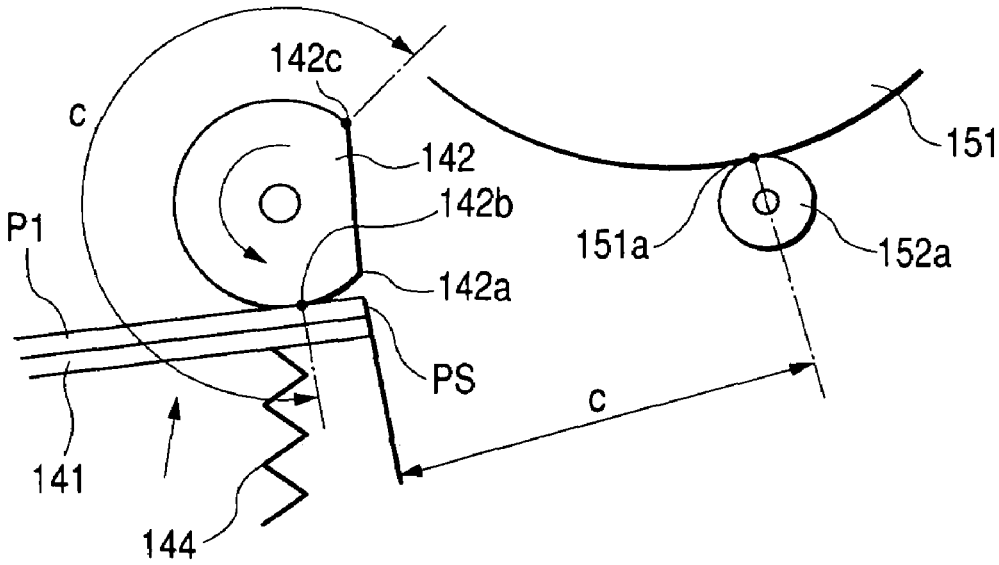

FIG. 6B shows a case where the minimum number (single) of cut sheet P1 is placed on the hopper 141. In this case, when the hopper 141 is moved upward, it is so configured that the cut sheet P1 is brought into contact with a point 142*b* which follows the point 142*a* according to the rotation of the paper feeding roller 142. The point 142*b* is so determined that a length "c" between the point 142*b* and a point 142*c* which is an end of the arcuate portion is made coincident with a length between a leading end PS of the cut sheet P1 and a nip point 151*a* of a sub roller 151 and a follower roller 152*a*.

According to such a configuration, if the number of cut sheets of paper P placed on the hopper 141 is less than the maximum number, the cut sheets P1 are not released from the paper feeding roller 142 until the leading edge PS of the top cut sheet P1 reaches the nip point 151*a* between the sub roller 151 and the follower roller 152*a*. Therefore, the cut sheets P1 can be reliably transferred to the sub roller 151. Hence, paper misfeeding can be prevented.

The sub roller 151 for conveying the paper, its follower rollers 152*a*, 152*b*, 152*c*, a paper feeding roller 153, its follower roller 154, a paper ejection roller 155, a corrugated roller 156, sensors 157*a*, 157*b* for detecting paper are disposed in the transporting section 150. A cut sheet fed from the paper feeding tray 210 is held between the sub roller 151 and the follower rollers 152*a*, 152*b*, and 152*c* to be transported through a U-shaped path. The proceeding direction is reversed via the U-shaped path so that the cut sheet is ejected to the paper ejection tray 230. Rolled paper fed from the paper feeder 130 is held between the sub roller 151 and the follower roller 152*c*, and transported to be ejected to the paper ejection tray 230.

The cut sheet of paper transported after reversed in direction or rolled paper fed in is held between the paper feeding roller 153 and follower roller 154 and sent out to a platen 163. The paper passed over the platen 163 is held between the ejection roller 155 and the corrugated roller 156 and ejected onto the ejection tray 230. The sensor 157*a* detects the amount of conveyance when skew of the cut sheet of paper fed in is corrected. The sensor 157*b* also detects the amount of conveyance when the positioning of the leading edge of the cut sheet conveyed after reversed in direction or rolled paper fed in is performed.

A carriage 161, a recording head 162 are disposed in the recording section 160. The carriage 161 is connected with a carriage belt (not shown). When the carriage belt is driven by a carriage driver (not shown), the carriage 161 is moved by the motion of the carriage belt. The carriage 161 is guided by a guide shaft (not shown) and reciprocated.

The recording head 162 has plural heads for plural kinds of black ink (e.g., ejecting two kinds of black ink) and heads for plural colors of inks for ejecting 6 colors of inks of yellow, dark yellow, cyan, light cyan, magenta, and light magenta. The recording head 162 is provided with pressure chambers each of which is associated with a nozzle orifice. Ink drops of controlled size are ejected toward the paper from the nozzle orifice by generating pressure fluctuation in ink stored in the pressure chamber.

Explanations will be given for the operation of the ink jet printer 100 thus configured in a case where the printing is performed with respect to a cut sheet of paper.

Cut sheets P accommodated within the paper feeding tray 210 of the cassette tray 200 mounted on the paper feeder/ejector 140 are pressed against the paper feeding roller 142 by the upward movement of the hopper 141 which is in cooperation with the rotation of the paper feeding roller 142, so that only the top cut sheet P1 is separated by the separator 143 and fed into the transporting section 150.

Figure 7A:
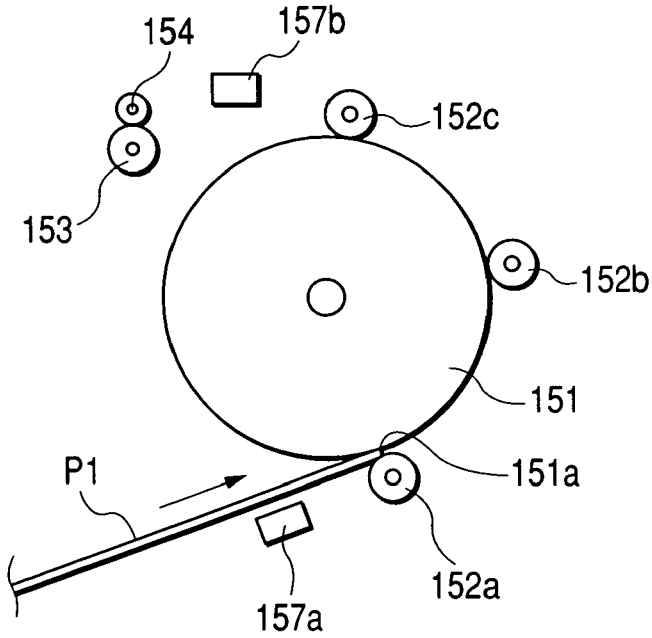
FIGS. 7A through 8B are schematic side views showing a state that a recording sheet is transported in the recording apparatus of FIG. 1.

When the fed cut sheet P1 reaches the nip point 151*a* between the sub roller 151 and the follower roller 152*a* as shown in FIG. 7A, the skew of the cut sheet P1 is corrected. This method of skew correction is different according to the paper thickness. In particular, in the case of a thin cut sheet of paper thinner than normal thickness paper, the leading edge of the cut sheet is inroad between the sub roller 151 and the follower roller 152*a* and the rollers 151 and 152*a* are then reversed to flex the cut sheet. Thus, the leading edge of the cut sheet is aligned. In this way, the skew is corrected.

On the other hand, in the case of a cut sheet thicker than normal thickness paper, the leading edge of the cut sheet is made to abut against the nip point 151*a*, and the paper feeding roller 142 is slipped, to align the leading edge of the cut sheet. In this way, the skew is corrected. The aforementioned amount of inroad and amount of abutment are detected by the sensor 157*a*. The skew correction is controlled according to the amounts of detection.

The method of skew correction is made different according to the paper thickness in this way, for the following reason. Since a thinner cut sheet is not stiff, there is an anxiety that the paper feeding roller 142 sends out the cut sheet without slipping on the paper. With respect to a thicker cut sheet, it is fabricated by bonding together thinner cut sheets. Therefore, when the rollers 151 and 152*a* are reversed, there is an anxiety of peeling.

Figure 7B:
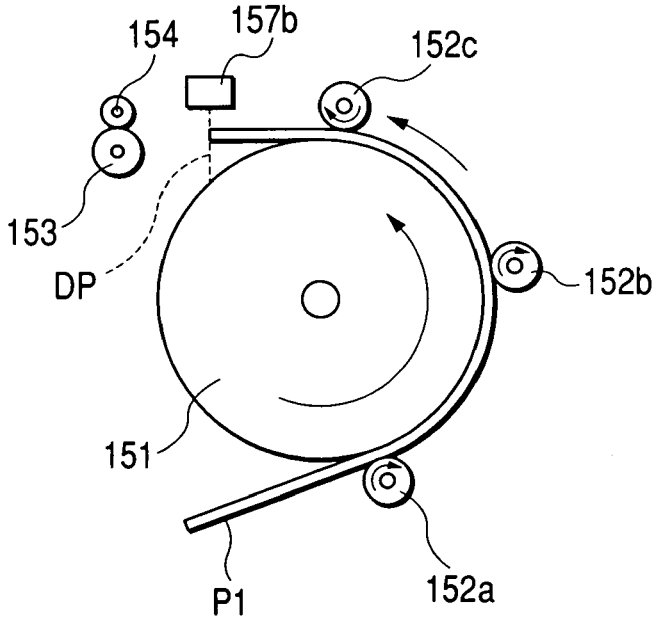

The cut sheet P1 undergone the skew correction is held between the sub roller 151 and the follower rollers 152*a*, 152*b*, and 152*c*, the sub roller 151 being driven by a paper feeding motor (not shown). The paper is reversed in direction on the U-shaped paper path. That is, the paper is transported in the direction opposite to the paper-feed direction. When the leading edge of the cut sheet P1 reaches the detection position DP of the sensor 157*b* as shown in FIG. 7B, the print start position of the cut sheet P1 is adjusted.

Figure 8A:
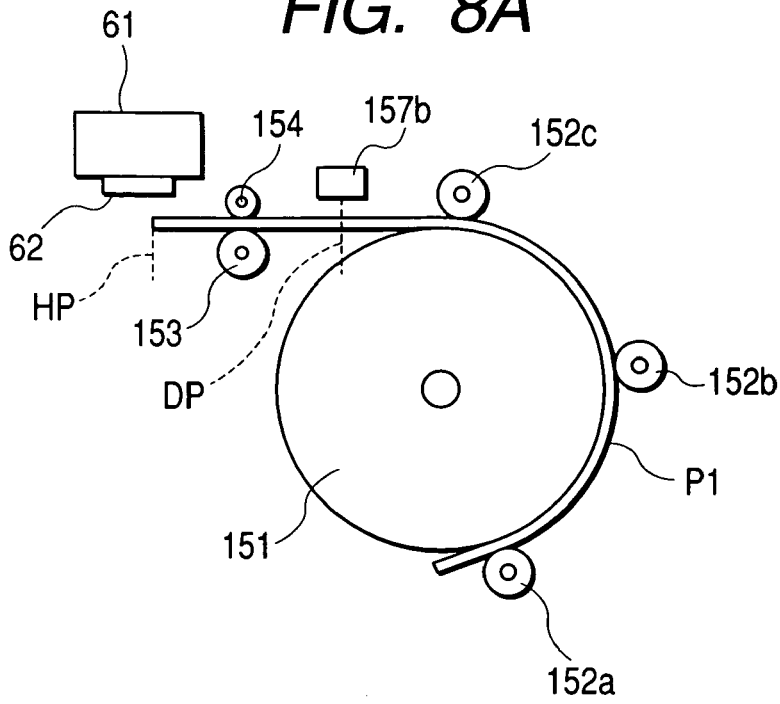

In particular, the amount of transport is detected by the sensor 157*b* until the leading edge of the cut sheet P1 passes from the detection position DP between the paper feeding roller 153 and the follower roller 154 and reaches the paper edge setting position HP shown in FIG. 8A. The setting of the leading edge of the paper is done according to the amount of detection. Conventionally, the positioning of the leading edge is performed using the sensor 157*a* mounted upstream of the sub roller 151. In this embodiment, the positioning is performed using the sensor 157*b* mounted downstream of the sub roller 151 so that the amount of detection can be reduced. Especially, the positioning error due to the paper thickness is prevented. Hence, the positioning accuracy of the paper leading edge can be enhanced.

Figure 8B:
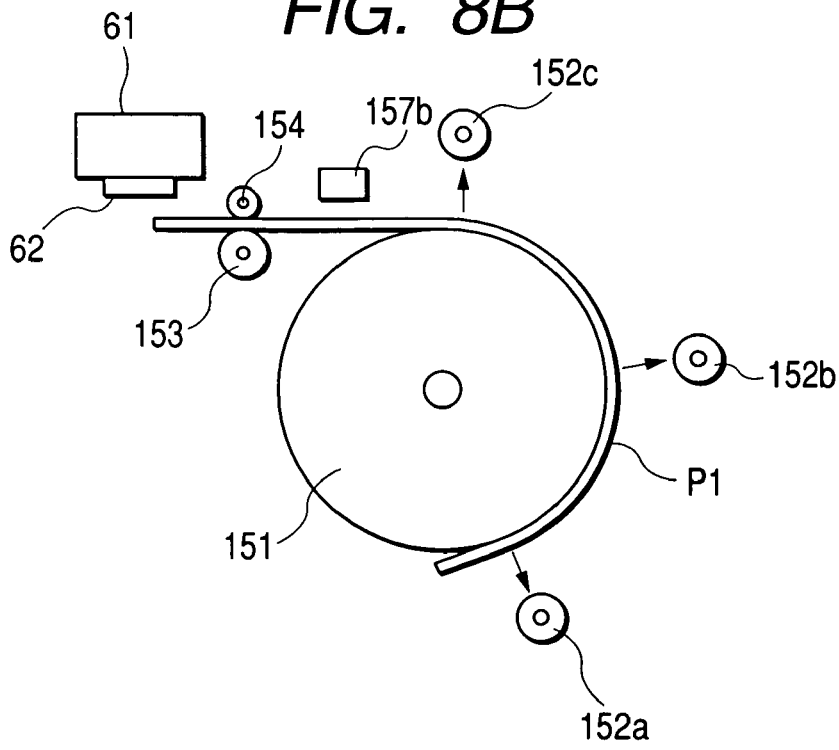

After then, the cut sheet P1 is held between the paper feeding roller 153 driven by the paper feeding motor (not shown) and the follower roller 154 and transported to the recording section 160. If the cut sheet P1 is kept held between the sub roller 151 and the follower rollers 152*a*, 152*b*, and 152*c*, the accuracy of the transportation will be deteriorated. Therefore, as shown in FIG. 8B, the follower rollers 152*a*, 152*b*, and 152*c* are separated from the sub roller 151.

The cut sheet P conveyed is attracted onto the platen 163 by a suction pump (not shown) and made flat. The printing is performed by the recording head 162 carried on the carriage 161 that is reciprocated by a carriage motor and a timing belt (none of which are shown). Incidentally, a control section of the ink jet printer 100 supplies colors of inks from ink cartridges of seven colors (e.g., yellow, dark yellow, magenta, light magenta, cyan, light cyan, and black) to the recording head 162. The timing at which each color ink is ejected is controlled. Also, the operation of the carriage 161 and paper feeding roller 153 is controlled to provide accurate control of ink dots and perform halftone processing. The printed cut sheet P1 is held between the ejection roller 155 driven by the paper feeding motor (not shown) and the corrugated roller 156 and ejected to the paper feeder/ejector 140. Then, the cut sheet P1 is stacked and placed on the paper ejection tray 230 of the cassette tray 200.

Figure 9:
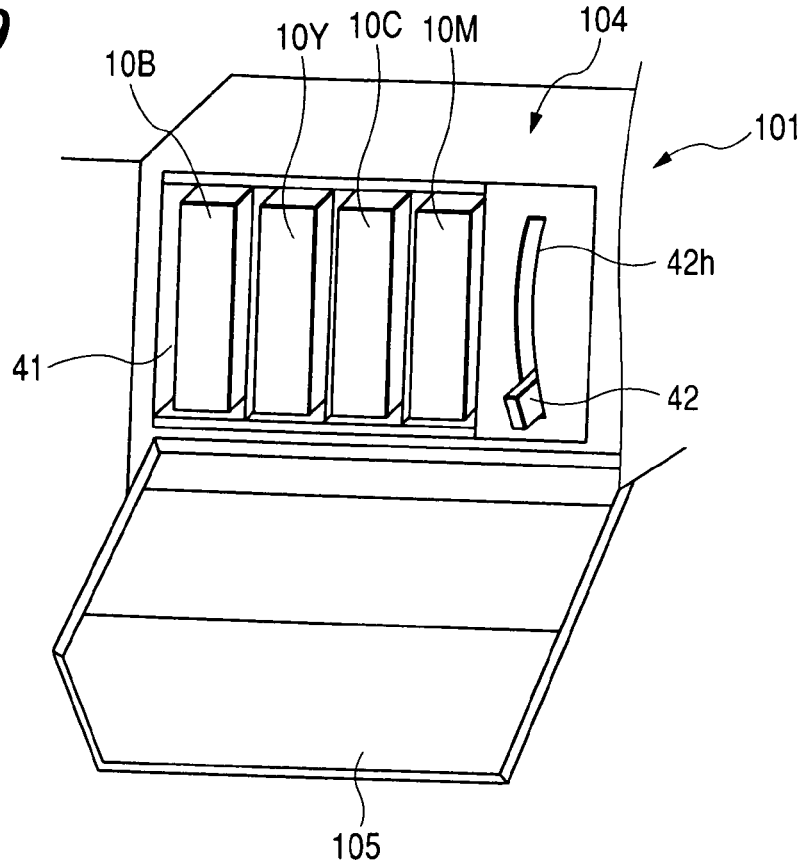
FIG. 9 is an enlarged perspective view of a cartridge chamber of the recording apparatus of FIG. 1.

To effectively utilize vacant regions formed on both sides of the front face of the housing 101 of the ink jet printer 100, the cartridge chambers 104 are disposed in the vacant regions. The cartridge chambers 104 are identical in structure and flush with the front face of the housing 101. Only the cartridge chamber 104 that is seen when the right cartridge cover 105 shown in FIG. 1 is opened is shown in FIG. 9. In this cartridge chamber 104, a holder 41 for receiving and holding four ink cartridges 10 and a control lever 42 capable of moving in the up-and-down direction are juxtaposed.

The cartridge cover 105 has a lower portion pivotably supported under the cartridge chamber 104. The cover pivots downwardly to open the front face of the cartridge chamber 104, and pivots upwardly to close the front face of the cartridge chamber 104. The holder 41 is partitioned such that the four ink cartridges 10 can be individually replaced. The holders 41 on both sides can accommodate and hold eight ink cartridges 10 in total.

Accordingly, ink cartridges 10B, 10Y, 10C, and 10M for four colors (e.g., pigment-based black, yellow, cyan, and magenta) are accommodated and held, for example, in the right holder 41 in FIG. 1. Ink cartridges for four colors consisting of dye-based black, dark yellow, light cyan, and light magenta are accommodated and held in the left holder 41. The dark yellow may be replaced by gray. Consequently, varied printing can be performed on various kinds of papers.

A large amount of printing can be performed continuously by accommodating and holding the same combination of ink cartridges 10B, 10Y, 10C, and 10M for black, yellow, cyan, and magenta in each of the right and left holders 41. That is, if the inks in the ink cartridges 10B, 10Y, 10C, and 10M held in the holder 41 on one side almost run out, the supply is stopped. The supply is switched to supply of the inks in the ink cartridges 10B, 10Y, 10C, and 10M held in the holder 41 on the other side.

When the inks in the ink cartridges 10B, 10Y, 10C, and 10M held in the holder 41 on the other side are being supplied, the ink cartridges 10B, 10Y, 10C, and 10M held in the holder 41 on one side are exchanged. A large amount of printing can be carried out without a pause by repeating these steps.

Figure 10:
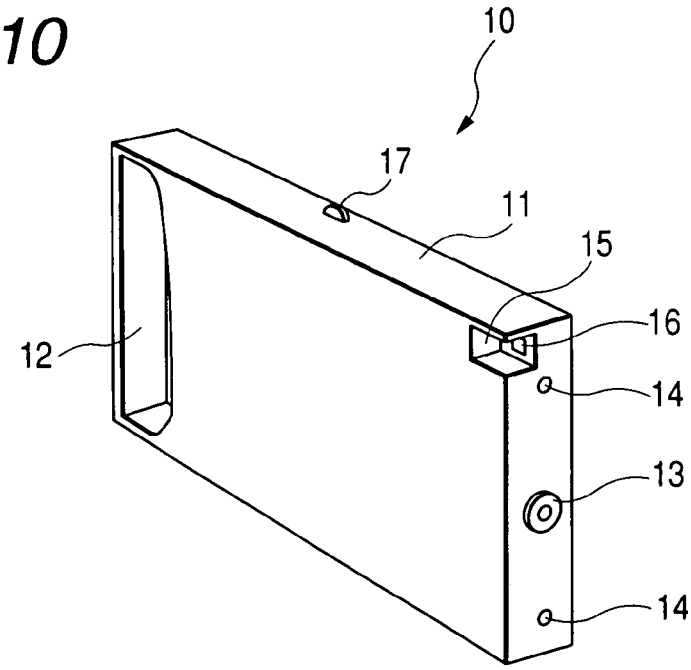
FIG. 10 is a perspective view of a rear side of an ink cartridge accommodated in the cartridge chamber of FIG. 9.

As shown in FIG. 10, the ink cartridge 10 consists of a box-shaped casing 11 fabricated from a hard plastic material, for example, and a bag-shaped ink tank is hermetically sealed within the casing 11. The ink tank is fabricated from a flexible material, for example, and filled with an ink. A concave gripping portion 12 on which user's hand is put when the ink cartridge 10 is pulled out of the holder 41 or pushed into it is formed on the front face side of one side face of the casing 11.

An ink supply port 13 which is connected with the internal ink tank and covered by rubber packing is formed in the center of the rear face of the casing 11. Positioning holes 14 used to place the ink cartridge 10 in position when it is pushed into the holder 41 are formed above and below the ink supply port 13.

A recess 15 is formed in an upper portion of the rear face of the casing 11. An IC 16 in which information about the ink in the ink cartridge 10 (e.g., manufacturing serial number, ink color, and the remaining amount) is rewritably stored is disposed inside the recess 15. A projection 17 is formed in the center of the top face of the casing 11 to be used to retain the ink cartridge 10 within the holder 41 (described later).

Figure 11:
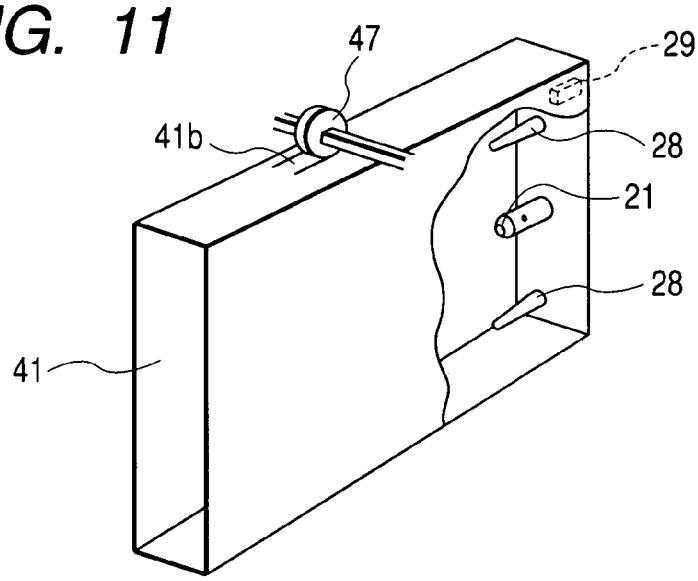
FIG. 11 is a schematic perspective view of a front side of the ink cartridge of FIG. 10.

As shown in FIG. 11, an ink supply needle 21 and positioning needles 28 respectively inserted into the ink supply port 13 and the positioning holes 14 in the ink cartridge 10 are disposed on the inner rear face of the holder 41. The ink supply needle 21 is provided with a valve mechanism 20 (see FIGS. 12 and 13) for connecting and disconnecting the ink supply port 13 in the ink cartridge 10 and the ink supply channel 1 (see FIG. 15) in the ink jet printer 100.

A connector 29 electrically connected with the IC 16 of the ink cartridge 10 is disposed on an upper portion of the inner rear face of the holder 41. The connector 29 is electrically connected with a flexible flat cable extending from the control section of the ink jet printer 100. The control section can read and write information about the ink to and from the IC 16 of the ink cartridge 10. Furthermore, a pawl 41*b* that is engaged with the projection 17 on the ink cartridge 10 in an interlocked way with a cam 47 is formed in the center of the upper face of the holder 41 (described later).

The control lever 42 is movable along a guide groove 42*h* formed vertically and adjacent to the cartridge chamber 104 as shown in FIG. 9. By actuating the control lever 42 up and down, the valve mechanism 20 connected with the ink supply port 13 in the ink cartridge 10 is opened and closed. Also, loading or unloading of the ink cartridge 10 with respect to the holder 41 is mechanically controlled. Furthermore, writing of the information about the ink into the IC 16 disposed in the ink cartridge 10 is electrically controlled.

Specifically, when the control lever 42 is placed at its highest position, the valve mechanism 20 connected with the ink supply port 13 in the ink cartridge 10 is closed. This permits the ink cartridge 10 to be moved relative to the holder 41. Writing of the information about the ink into the IC 16 disposed in the ink cartridge 10 is inhibited.

On the other hand, when the control lever 42 is placed in its lowest position, the valve mechanism 20 connected with the ink supply port 13 in the ink cartridge 10 is opened. This does not permit the ink cartridge 10 to be moved relative to the holder 41. Writing of the information about the ink into the IC 16 disposed in the ink cartridge 10 is enabled.

The detailed structure for realizing the above configurations will be described with reference to FIG. 12.

The control lever 42 has a one side projected from the front face of the holder 41 as a control end 42*a*. The other side is rotatably supported on the side face 41*a* of the holder 41 by a shaft 42*b*.

A guide face 42*c* involved with writing of the information about the ink into the IC 16 disposed in the ink cartridge 10 is formed at an end on the other end side of the control lever 42. Gear teeth 42*d* involved with loading and unloading of the ink cartridge 10 relative to the holder 41 are formed in an upper portion on the other end side of the control lever 42. An engagement portion 42*e* involved with the motion of the control lever 42 itself is formed in a lower portion. Furthermore, gear teeth 42*g* involved with opening and closing of the valve mechanism 20 connected with the ink supply port 13 in the ink cartridge 10 are formed in a lower portion.

Stoppers 42*f* for determining the top and bottom positions of the motion of the control lever 42 are projected from the front face side of the side face 41*a* of the holder 41. A limit switch 43 that is turned on or off by the guide face 42*c* in accordance with the motion of the control lever 42 is disposed on the rear face side of the side face 41*a* of the holder 41.

A sector gear 44 that meshes with the gear teeth 42*d* and rotates when the control lever 42 is moved is fitted in a hexagonal shaft 46 disposed on the upper face side of the holder 41. A torsion coil spring 45 urges the control end 42*a* when it is in its top or bottom position. One end of the spring 45 is anchored to the engagement portion 42*e*, the other end being secured to the side face 41*a* of the holder 41.

The hexagonal shaft 46 extends from one end to the other end of the top faces of the holders 41 for all the colors. The cam 47 is fitted in a position corresponding to the top face of each holder 41. The cam 47 can push down the pawl 41*b* formed on the top face of each holder 41 for retaining the ink cartridge 10 therein.

A gear train 48 meshes with the gear teeth 42*g* and rotates when the control lever 42 is moved. A sector gear 49 meshes with the gear train 48 and rotates. The gear train 48 and sector gear 49 are fitted over a cam shaft 22*c* forming the cam mechanism 22 for opening and closing the valve mechanism 20 disposed on the back face side of each holder 41. The cam shaft 22*c* extends from one end to the other on the rear face sides of the holders 41 for all the colors. A cam 22*a* forming the cam mechanism 22 is fitted in a position corresponding to the back face of each holder 41.

Figure 13:
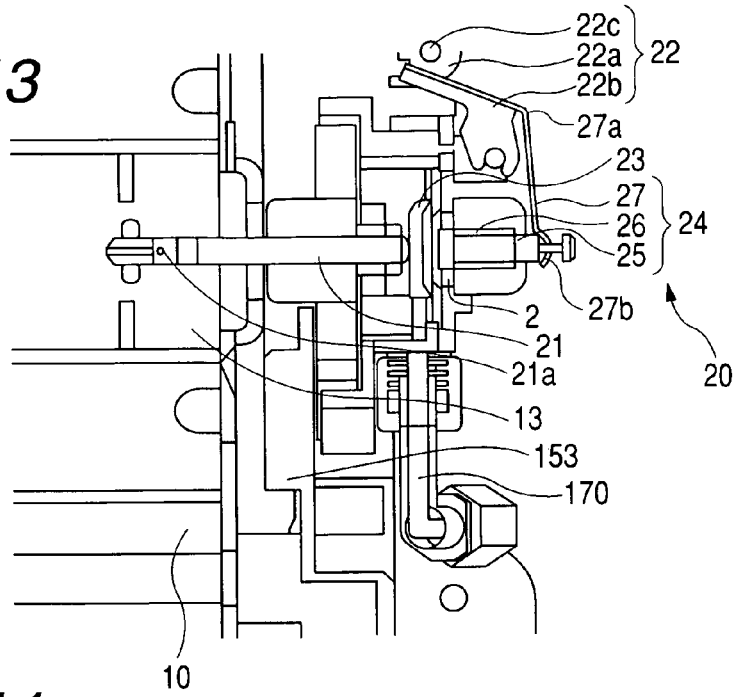
FIG. 13 is an enlarged view of a valve mechanism in the liquid supply device of FIG. 12.

As shown in FIG. 13, the valve mechanism 20 has the ink supply needle 21, cam mechanism 22, valve 23, and a mechanism 24 for opening and closing the valve 23. The mechanism 24 opens and closes the valve according to the motion of the control lever 42. The ink supply needle 21 is hollowed and formed with a supply port 21*a* at a side face of a front end thereof. The front end protrudes from the inner rear face of the holder 41, while the rear end is connected with the ink supply channel 1 formed in the rear face of the holder 41. The ink supply needle 21 is detachably inserted into the ink supply port 13 in the ink cartridge 10 when the ink cartridge 10 is loaded in the holder 41.

The cam mechanism 22 has the cam 22*a*, an L-shaped cam lever 22*b* consists of a flat plate, and the cam shaft 22*c*. One end of the lever 22*b* is pivotably supported on the back face of the holder 41, while the other end abuts against the cam 22*a*. The cam 22*a* is fitted over a position on the cam shaft 22*c* corresponding to the back face of each holder 41. The cam 22*a* is so disposed that as the control lever 42 moves from its top position to its bottom position, the control lever can push down the cam lever 22*b*.

The valve 23 is molded into a disk-shaped from a thermoplastic elastomer or the like. The fringes are held within a space 2 including the ink supply channel 1, the space 2 being formed in the rear face of the holder 41. Thus, by moving the control lever 42 from its top position to its bottom position, the valve 23 can be flexed away from the ink supply channel 1 within the space 2 by the action of the cam mechanism 22 and a flat metal member 27 (described later). Meanwhile, by moving the control lever 42 from its bottom position to its top position, the valve 23 can be flexed into abutment with the ink supply channel 1 within the space 2 by the action of the cam mechanism 22 and a compression spring 26 (described later).

The mechanism 24 for opening and closing the valve 23 includes an actuating shaft 25 connected with the valve 23, the compression spring 26 which urges the actuating shaft 25, and the flat metal member 27 which connects the actuating shaft 25 and the cam lever 22*b* in an interlocking manner. The mechanism 24 interlocks with the motion of the control lever 42. The front end of the actuating shaft 25 is connected with the valve 23 within the space 2, the rear end being so disposed that it protrudes from the outer rear face of the holder 41 so as to be slidable in the axial direction thereof. The compression spring 26 for urging the ink supply channel 1 in the direction to close the channel by the valve 23 is mounted to the shaft portion in the space 2.

The flat metal member 27 is an L-shaped member. One end of this member is fixed to the cam lever 22*b*, while the other end is connected to the rear end of the actuating shaft 25. That is, the metal member 27 serves as a lever that uses a portion 27*a* as a point at which a load or force is applied, and uses a portion 27*b* as a point at which the force or load is applied. The lever uses the rotating shaft of the cam lever 22*b* as a fulcrum. In this way, the actuating shaft 25 can be made to protrude from the outer rear face of the holder 41 by the action of the cam mechanism 22 and the flat metal member 27, by moving the control lever 42 from its top position to its bottom position. The actuating shaft 25 can be returned to within the outer rear face of the holder 41 by the action of the cam mechanism 22 and the compression spring 26, by moving the control lever 42 from its bottom position to its top position.

The operation of the mechanism of the control lever 42 will be described with reference to FIGS. 12-15. When the control lever 42 is placed at its top position as shown in FIG. 12, one end of the cam lever 22*b* of the cam mechanism 22 is located at a higher position as shown in FIG. 13. The other end of the flat metal member 27 is not in contact with the rear end of the actuating shaft 25 so that the restoring force of the compression spring 26 has brought the actuating shaft 25 close to the ink supply needle 21. Consequently, the valve 23 is flexed into abutment with the ink supply channel 1 within the space 2. Accordingly, the ink supply channel 1 is closed by the valve 23.

Figure 12:
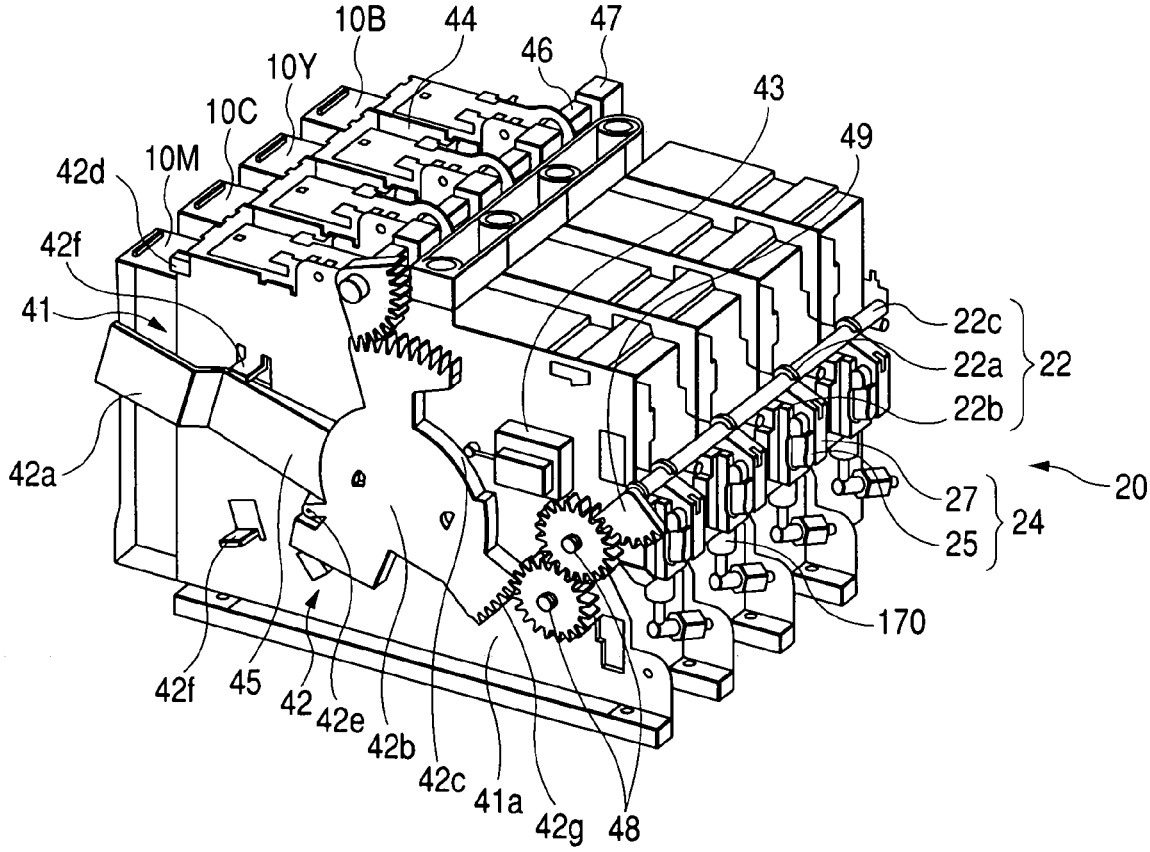
FIG. 12 is a perspective view of a liquid supply device incorporated in the recording apparatus of FIG. 1, showing a state that a control lever is placed at an upper position.

As shown in FIG. 12, the limit switch 43 is turned off by the guide face 42*c*. Writing of the information about the ink into the IC 16 is inhibited. Furthermore, the cam 47 has been moved away from the pawl 41*b* by rotation of the gear 44 caused by the gear teeth 42*d*. Since the pawl 41*b* is at a distance from the projection 17 formed on the ink cartridge 10, the ink cartridge 10 can be moved relative to the holder 41.

Figure 14:
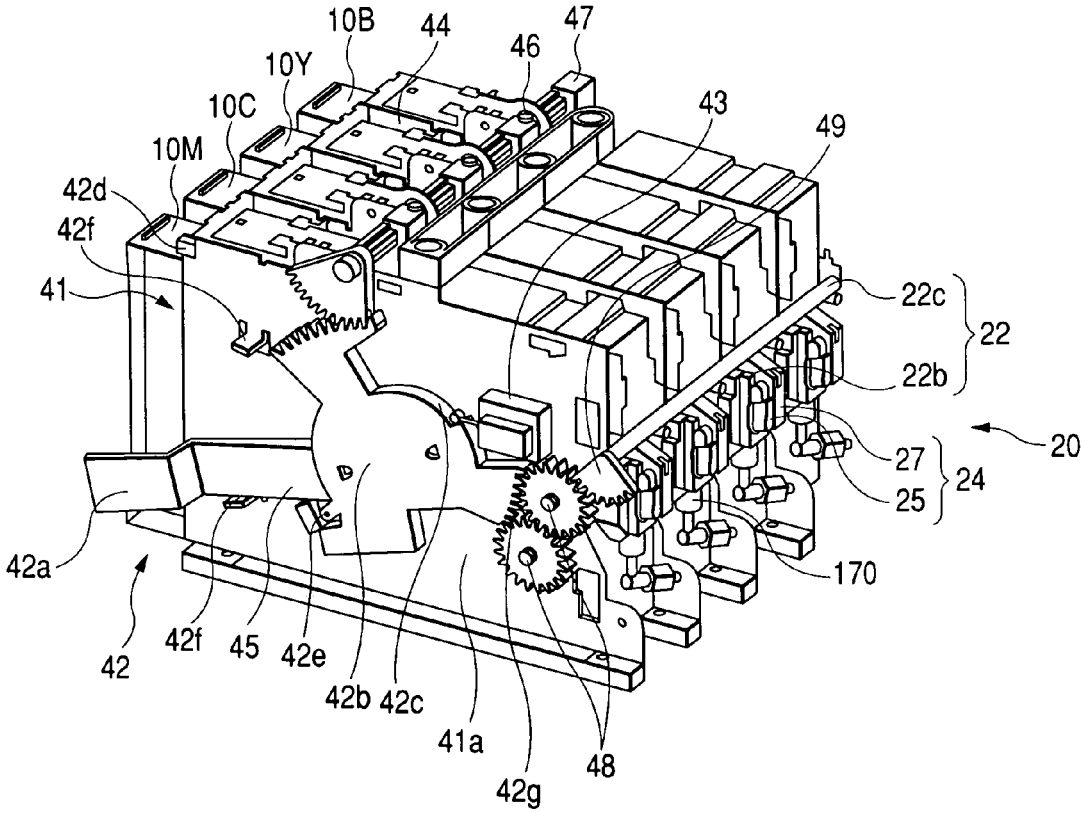
FIG. 14 is a perspective view of the liquid supply device, showing a state that a control lever is placed at a lower position.
Figure 15:
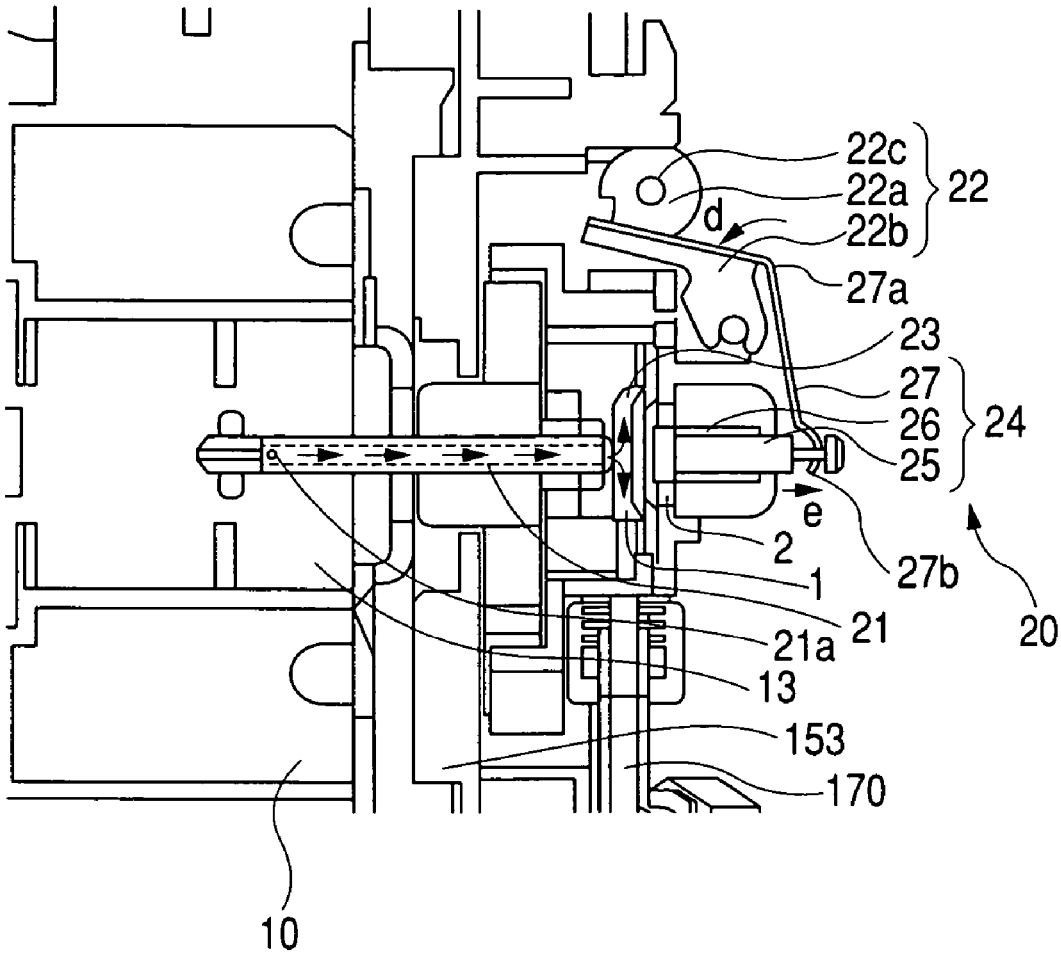
FIG. 15 is an enlarged view of the valve mechanism in the state shown in FIG. 14.

On the other hand, when the control lever 42 is placed at its bottom position as shown in FIG. 14, one end of the cam lever 22*b* of the cam mechanism 22 is located at a lower position as shown in FIG. 15. As this cam lever 22*b* rotates in the direction of an arrow "d", the actuating shaft 25 moves away from the ink supply needle 21 because the other end of the flat metal member 27 pushes the rear end of the actuating shaft 25 in the direction of an arrow "e". As such, the valve 23 is flexed away from the ink supply channel 1 within the space 2 and so the ink supply channel 1 covered by the valve 23 is exposed. The ink within the ink tank of the ink cartridge 10 passes through the supply port 21*a* in the ink supply needle 21 from the ink supply port 13 as indicated by the shown arrows and is supplied into an ink tube (not shown) connected with a joint 170 via the ink supply channel 1.

This ink tube is mounted for each color of ink as described above. One end of each ink tube is connected with the corresponding ink cartridge 10 for each color via means (not shown) for applying pressure to the ink and supplying the ink. The other end is connected with the corresponding recording head 162 for each color. The ink tube sends the ink of each color to which pressure is applied by the aforementioned means from the ink cartridge 10 into the recording head 162.

As shown in FIG. 14, the limit switch 43 is turned on by the guide face 42*c*. Writing of information about the ink into the IC 16 is enabled. The cam 47 pushes the pawl 41*b* by rotation of the gear 44 caused by the gear teeth 42*d*. Since the pawl 41*b* is in engagement with the projection 17 formed on the ink cartridge 10, the motion of the ink cartridge 10 relative to the holder 41 is inhibited.

That is, the valve 23 cannot be opened only if the user loads the ink cartridge 10 in the holder 41, but can be opened when the control lever 42 is operated after the loading of the ink cartridge to communicate the ink cartridge 10 with the ink supply channel 1. On the other hand, upon the unloading of the ink cartridge 10, the valve 23 cannot be closed unless the user operates the control lever 42 to disconnect the ink cartridge 10 from the ink supply channel 1.

Conventionally, since the valve is opened or closed simultaneously with loading or unloading of the ink cartridge, air tends to enter the ink tube when the cartridge is replaced. For this reason, if air enters when only one ink cartridge is replaced, for example, the ink in all the ink cartridges are consumed in large amounts due to removal of the air. Furthermore, there is an anxiety that ink leaks during loading or unloading of any ink cartridge, contaminating the inside of the apparatus.

In the present embodiment, however, the ink cartridge 10 is inserted into the holder 41 so that the ink supply needle 21 completely enters the ink supply port 13 in the ink cartridge 10. After then, the control lever 42 is lowered to open the valve 23. On the other hand, the ink cartridge 10 is withdrawn from the holder 41 after the control lever 42 is raised. Accordingly, where only one ink cartridge is replaced, for example, entry of air into the ink tube can be prevented completely. In addition, contamination of the inside of the apparatus due to ink leakage can be prevented.

Choke cleaning can be performed by moving the control lever 42 to its bottom position after negative pressure is applied to the ink tube in a condition that the control lever 42 is placed at its top position. Additionally, conventional electromagnetic valves can be omitted. Hence, the cost of parts can be reduced.

The compression spring 26 coupled with the actuating shaft 25 may be omitted by configuring the flat metal member 27 so as to serve as a leaf spring.

The user cannot pull the ink cartridge 10 out of the holder 41 unless he lifts the control lever 42 from its bottom position to its top position. The control panel of the ink jet printer 100 can write the information about the ink into the IC 16 disposed in the ink cartridge 10 while the user is lifting the lever 42 from its bottom position to its top position. Accordingly, malfunction of the ink jet printer 100 due to incapability of reading and writing the ink information can be prevented.

Furthermore, the provision of the control lever 42 makes it possible to use a large-sized ink cartridge. That is, conventionally, writing of the ink information into the IC disposed in the ink cartridge has been controlled by opening and closing of the cartridge cover of the cartridge chamber. However, the large-sized ink cartridge may project from the front face side when it is loaded in the holder, so that the cartridge cover cannot be closed. Consequently, it has been impossible to control the writing of the ink information into the IC disposed in the ink cartridge.

In contrast, writing of the ink information into the IC 16 disposed in the ink cartridge 10 according to the present embodiment is controlled by the motion of the control lever 42 as described above. Therefore, even if a large-sized ink cartridge projects from the front face side and the cartridge cover 105 cannot be closed, writing of the ink information into the IC disposed in the large-sized ink cartridge can be controlled.

In the embodiment, when the control lever 42 is in its bottom position, writing of the ink information into the IC 16 is enabled and the ink information is written into the IC 16 before the control lever 42 arrives its top position. Instead, the control lever 42 and the IC 16 may be configured as follows.

The ink information is written into the IC 16 at predetermined timings such as before or after the recording operation of the recording head 162, before or after the cleaning operation of the recording head 162, and when a predetermined amount of ink is consumed. The information writing is inhibited simultaneously when the control lever 42 is moved from its bottom position. In this configuration, the information writing can be performed securely, thereby preventing malfunction of the ink jet printer 100.

As mentioned previously, pressure is applied to the ink within the ink cartridge 10 for each color accommodated in the cartridge chamber 104 and sent to the recording head 162 by the means for applying pressure to the ink and supplying it. Consequently, in the case of ink supply means utilizing a water head difference as in the prior art ink jet printer, it has been necessary to dispose the ink cartridge holder above the carriage. This cartridge chamber 104 can supply ink wherever it is positioned. Hence, it can be positioned at any location.

As described so far, in the ink jet printer 100 according to the present embodiment, the valve 23 fitted in the liquid supply channel 1 is opened and closed in an interlocked way with the operation of the control lever 42 fitted in the cartridge chamber 104. Accordingly, the valve 23 cannot be opened or closed unless the user operates the control lever 42. Consequently, it is unlikely that the user misrecognizes the state of the valve 23 (i.e., whether it is open or closed). Therefore, when the ink cartridge 10 is attached or detached, inflow of air into the fluid supply channel 1 can be prevented with certainty.

In addition, there is provided the cam mechanism 22 for transmitting the operation of the control lever 42 to the mechanism 24 for opening and closing the valve 23. Therefore, it is assured that the operation of the control lever 42 is mechanically transmitted to the mechanism 24 for opening and closing the valve 23. Accordingly, the valve 23 can be opened and closed with certainty. The mechanism 24 for opening and closing the valve 23 has the actuating shaft 25 connected with the valve 23, compression spring 26 for urging the actuating shaft 25 in the direction to close the liquid supply channel 1 by the valve 23, and flat metal member 27 for connecting the actuating shaft 25 and cam mechanism 22. Accordingly, the liquid supply channel 1 can be closed by the valve 23 simultaneously with operation of the control lever 42. Consequently, the ink supply port 13 in the ink cartridge 10 and the liquid supply channel 1 can be disconnected reliably.

Since the flat metal member 27 is fabricated as a lever, the actuating shaft 25 can be operated simply by lightly operating the control lever 42. The ink supply port 13 in the ink cartridge 10 and the liquid supply channel 1 can be connected reliably.

While the present invention has been described so far in relation to its various embodiments, the invention is not limited thereto. Of course, the invention is also applied to other embodiments within the scope of the invention delineated by the appended claims. For example, in the above embodiments, an ink jet printer is taken as an example of a recording apparatus. The apparatus is not limited to the ink jet printer. The invention can also be applied to any recording apparatus using ink cartridges such as facsimile machines and copiers.

In addition, the invention is not limited to recording apparatus. The invention can also be applied to liquid ejection apparatus for ejecting liquid corresponding to the application instead of ink from a liquid ejection head so that the ejected liquid adheres onto a medium corresponding to the application. The liquid ejection apparatus may include colorant ejection heads used for manufacture of color filters for liquid crystal displays, electrode material (conductive paste) ejection heads used for fabrication of electrodes for organic EL displays and field emission displays (FEDs), biological organics ejection heads used for manufacture of biochips, and specimen ejection heads acting as accurate pipettes.

What is claimed is:

1. A device for supplying liquid from a liquid cartridge to a liquid ejection head, the device comprising:

a cartridge chamber, adapted to accommodate the liquid cartridge;

a liquid supply channel adapted to supply liquid from the liquid cartridge to the liquid ejection head;

a retainer, operable to releasably retain the liquid cartridge in the cartridge chamber;

a valve, disposed on the liquid supply channel and operable to open or close the liquid supply channel; and a control lever, adapted to be manually operated by a user to control whether the valve opens or closes the liquid supply channel without moving the liquid cartridge and whether the retainer releases or retains the liquid cartridge.

2. The device as set forth in claim 1, wherein the retainer being operated interlockingly with the operation of the control lever.

3. The device as set forth in claim 1, wherein the retainer releases the retention of the retainer only when the control lever is operated such that the valve disconnects the liquid cartridge from the liquid supply channel.

4. The device as set forth in claim 3, wherein the retainer releases the retention of the retainer when the control lever is manually operated.

5. The device as set forth in claim 1, further comprising a transmitter which converts the operation of the control lever into the connecting or disconnecting operation of the valve in a leverage manner.

6. The device as set forth in claim 1, wherein the release or retention of the liquid cartridge is controlled interlockingly with the manual operation of the control lever.

7. A device for supplying liquid from a liquid cartridge, which has a storage operable to store information, to a liquid ejection head via a liquid supply channel, the device comprising:

a cartridge chamber adapted to accommodate the liquid cartridge;

a valve, operable to open or close the liquid supply channel; and a control lever, operable to control whether the valve opens or closes the liquid supply channel without moving the liquid cartridge and whether writing of the information into the storage is enabled or inhibited without moving the liquid cartridge.

8. The device as set forth in claim 7, wherein the writing of the information is enabled when the control lever is operated such that the valve opens the liquid supply channel.

9. The device as set forth in claim 8, wherein the writing of the information is inhibited when the control lever is operated such that the valve closes the liquid supply channel.

10. A liquid ejection apparatus, comprising:

a liquid ejection head, from which a liquid droplet is ejected;

a liquid supply path, communicated with the liquid ejection head to supply liquid thereto from a liquid cartridge;

a cartridge chamber, which accommodates the liquid cartridge;

a retainer, which is operable to releasably retain the liquid cartridge in the cartridge chamber;

a valve, disposed on the liquid supply channel and operable to open or close the liquid supply channel; and a control lever, adapted to be manually operated by a user to control whether the valve opens or closes the liquid supply channel without moving the liquid cartridge and whether the retainer releases or retains the liquid cartridge.

11. The apparatus as set forth in claim 10, wherein the release or retention of the liquid cartridge is controlled interlockingly with the manual operation of the control lever.

12. A liquid ejection apparatus, comprising:

a liquid ejection head, from which a liquid droplet is ejected;

a liquid supply path, communicated with the liquid ejection head to supply liquid thereto from a liquid cartridge provided with a storage operable to store information;

a cartridge chamber, which accommodates the liquid cartridge;

a valve, operable to open or close the liquid supply channel; and a control lever, operable to control whether the valve opens or closes the liquid supply channel without moving the liquid cartridge and whether writing of the information into the storage is enabled or inhibited without moving the liquid cartridge.

13. The liquid ejection apparatus as set forth in claim 12, wherein the writing of the information into the storage is enabled when the control lever is operated to control the valve to open the liquid supply channel.

14. A device for supplying liquid from a liquid cartridge to a liquid ejection head, comprising:

a cartridge chamber, adapted to accommodate the liquid cartridge;

a liquid supply channel adapted to supply liquid from the liquid cartridge to the liquid ejection head;

a retainer, operable to releasably retain the liquid cartridge in the cartridge chamber;

a valve, operable to open or close the liquid supply channel; and a control lever, operable to control whether the valve opens or closes the liquid supply channel without moving the liquid cartridge and whether the retainer releases or retains the liquid cartridge.

* * * * *